US006091186A

United States Patent [19]

Cao et al.

[11] Patent Number: 6,091,186

[45] Date of Patent: Jul. 18, 2000

[54] CARBON-CONTAINING CATHODES FOR ENHANCED ELECTRON EMISSION

[75] Inventors: Renyu Cao, Cupertino; Lawrence Pan, Pleasanton, both of Calif.; German Vergara, Madrid, Spain; Ciaran Fox, Los Altos, Calif.

[73] Assignees: The Board of Trustees of the Leland Stanford Junior University, Palo Alto; Sandia National Laboratories, Livermore, both of Calif.

[21] Appl. No.: 08/748,690

[22] Filed: Nov. 13, 1996

[51] Int. Cl.[7] ..... H01J 1/30; H01J 19/24

[52] U.S. Cl. ..... 313/310; 313/346 R; 257/77; 257/11; 445/50; 445/51

[58] Field of Search ..... 313/310, 346 R, 313/346 DC, 345, 355, 270, 337, 311, 336, 351; 254/77, 103, 10, 11, 12; 445/49, 50, 24, 25, 51

[56] References Cited

U.S. PATENT DOCUMENTS

| | | | |
|---|---|---|---|
| 3,814,979 | 6/1974 | Eberhardt | 315/11 |
| 4,447,151 | 5/1984 | McLellan et al. | 313/524 |
| 5,463,271 | 10/1995 | Geis et al. | 313/346 R |
| 5,489,817 | 2/1996 | Muller et al. | 313/495 |

OTHER PUBLICATIONS

Pate, B., *The diamond surface: atomic and electronic structure,* Surface Science, 165, pp. 83–142, 1986.

Fox, C. et al, *Photoelectron emission from the cesiated diamond (110) surface,* Mat. Res. Soc. Symp. Proc., vol. 416, pp. 449–545, 1996.

Mori, Y et al, *Properties of metal/diamond interfaces and effects of oxygen adsorbed onto diamond surface,* Appl. Phys. Lett., 58 (9), pp. 940–941, 1991.

*Primary Examiner*—Nimeshkumar D. Patel
*Assistant Examiner*—Joseph Williams
*Attorney, Agent, or Firm*—Lumen Intellectual Property Services

[57] ABSTRACT

A cathode has electropositive atoms directly bonded to a carbon-containing substrate. Preferably, the substrate comprises diamond or diamond-like ($sp^3$) carbon, and the electropositive atoms are Cs. The cathode displays superior efficiency and durability. In one embodiment, the cathode has a negative electron affinity (NEA). The cathode can be used for field emission, thermionic emission, or photoemission. Upon exposure to air or oxygen, the cathode performance can be restored by annealing or other methods. Applications include detectors, electron multipliers, sensors, imaging systems, and displays, particularly flat panel displays.

23 Claims, 9 Drawing Sheets

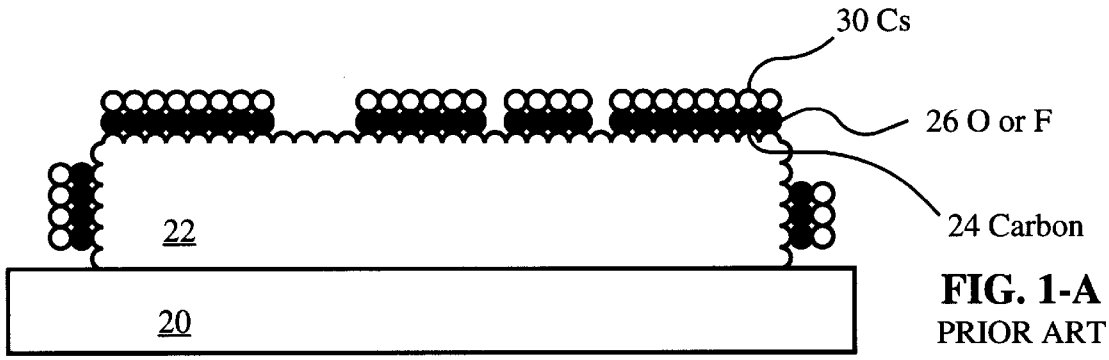
FIG. 1-A
PRIOR ART
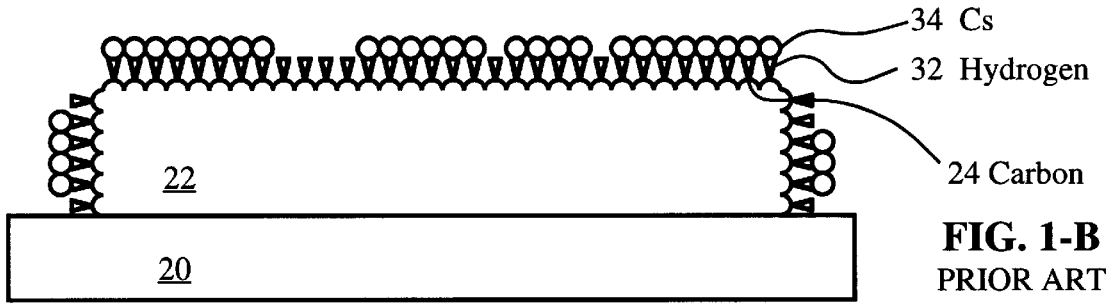
FIG. 1-B
PRIOR ART
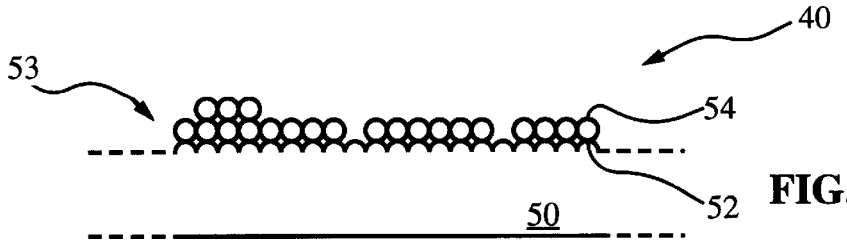
FIG. 2

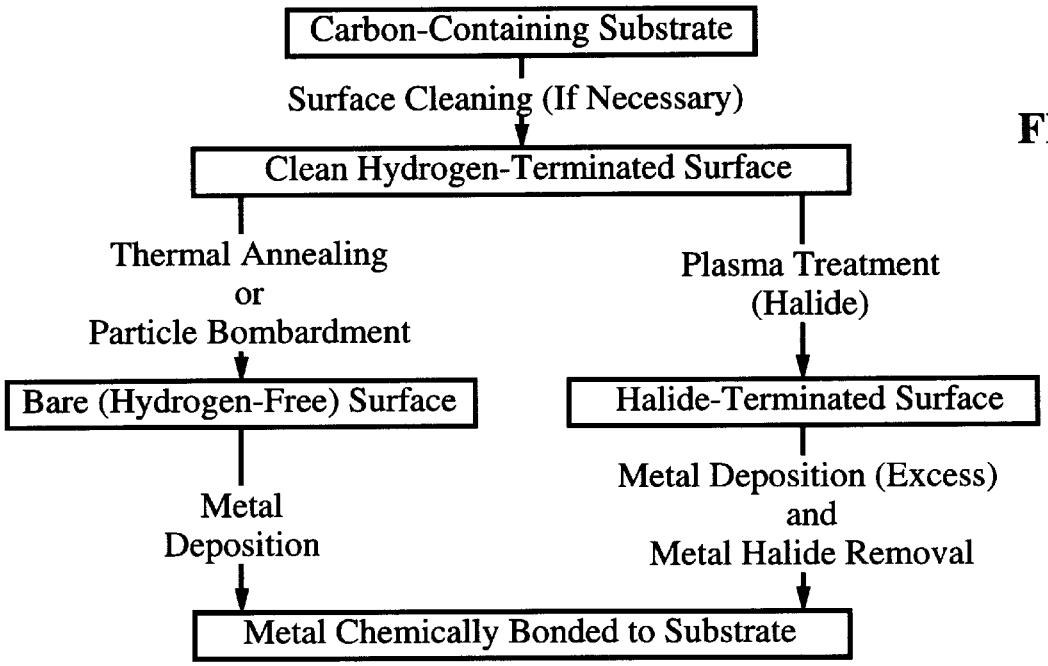
FIG. 3
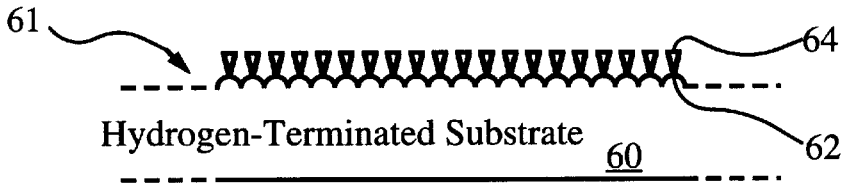
FIG. 4-A
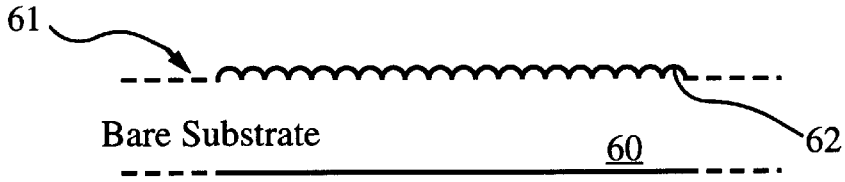
FIG. 4-B
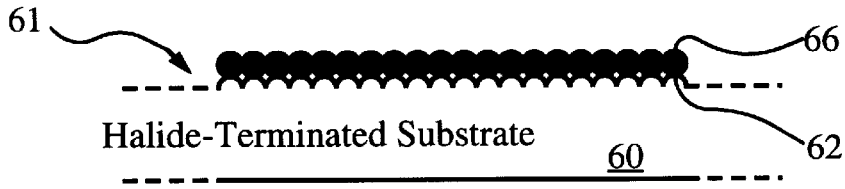
FIG. 4-B'
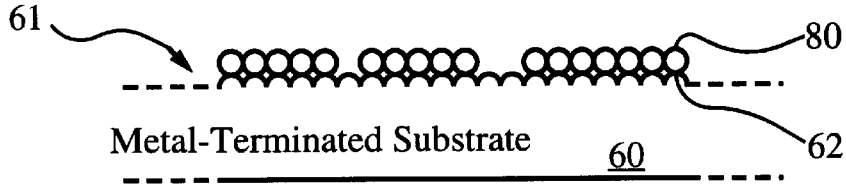
FIG. 4-C

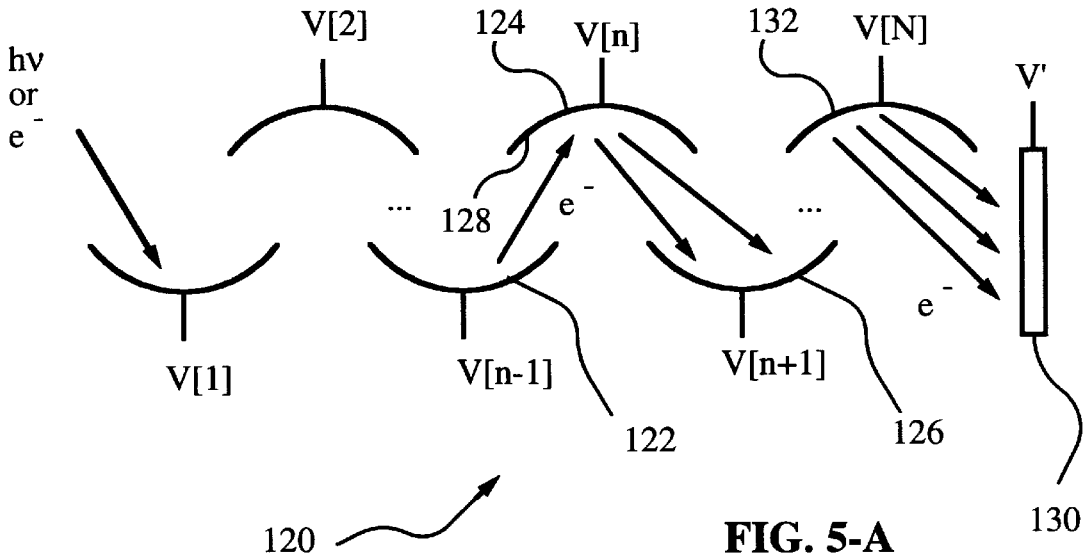
FIG. 5-A
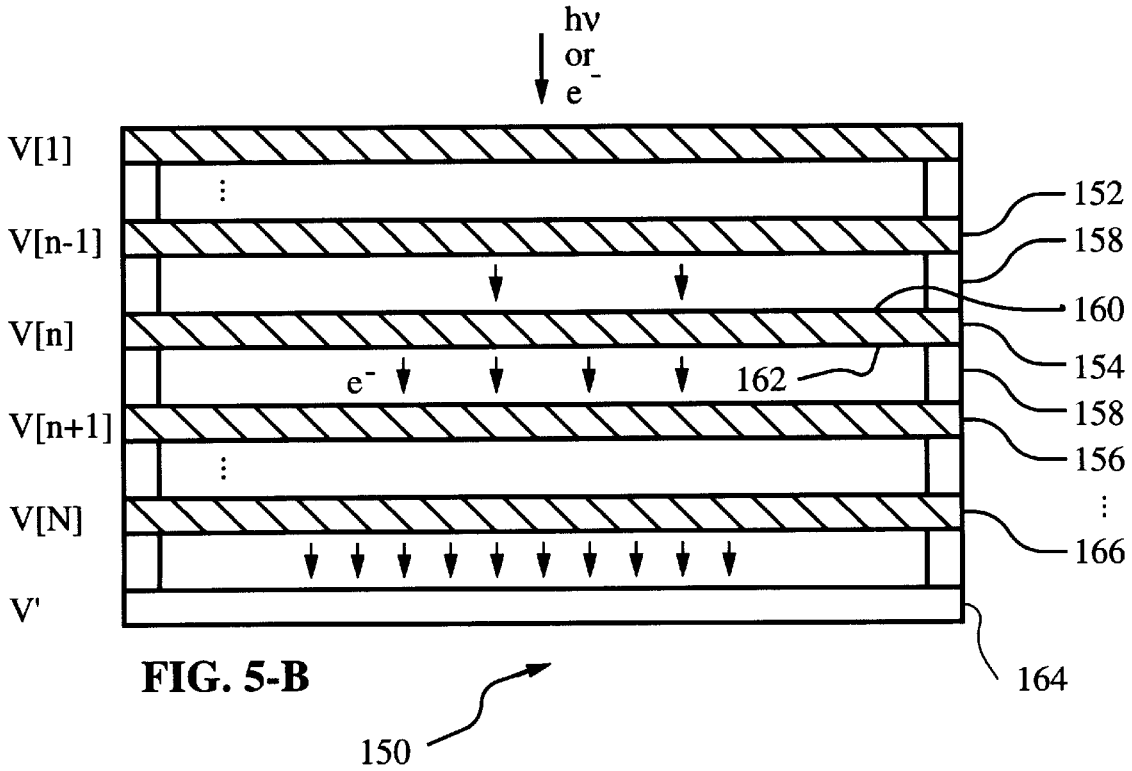
FIG. 5-B

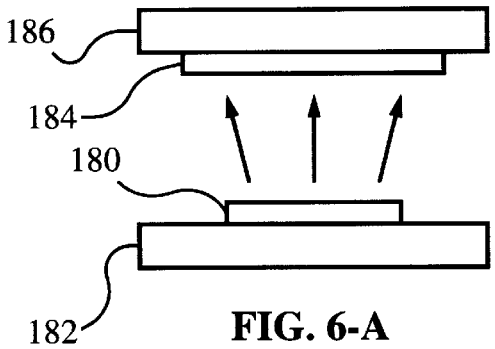
FIG. 6-A
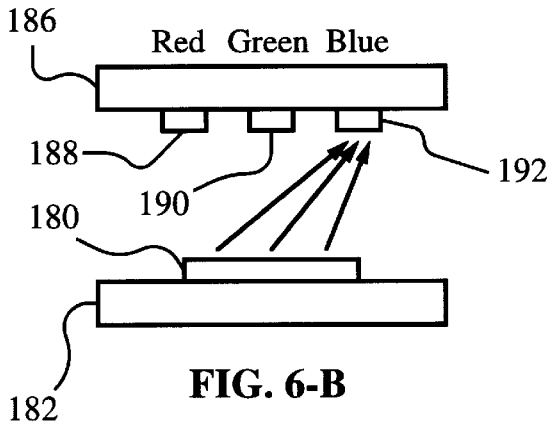
FIG. 6-B
FIG. 7
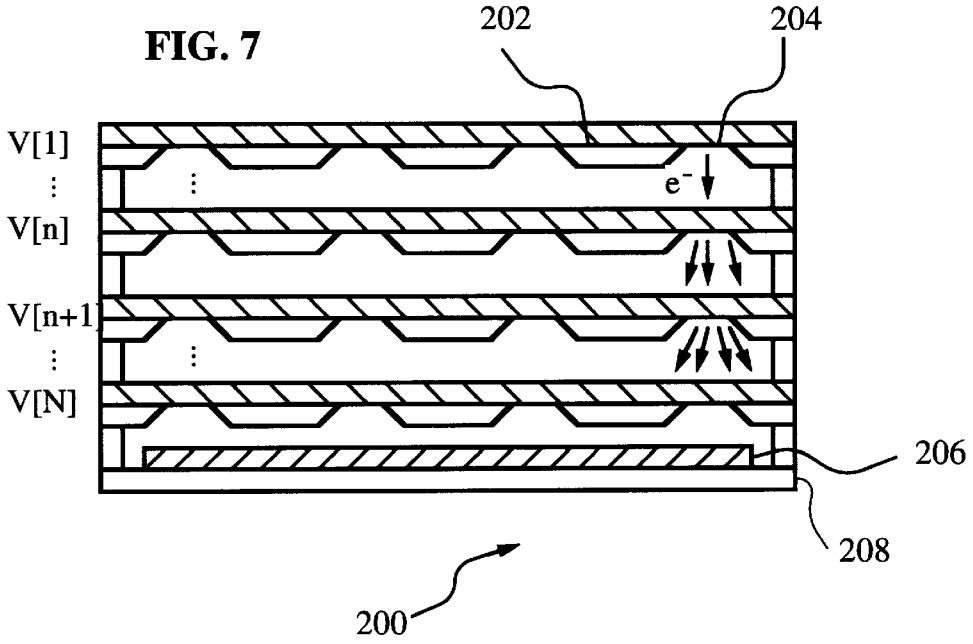

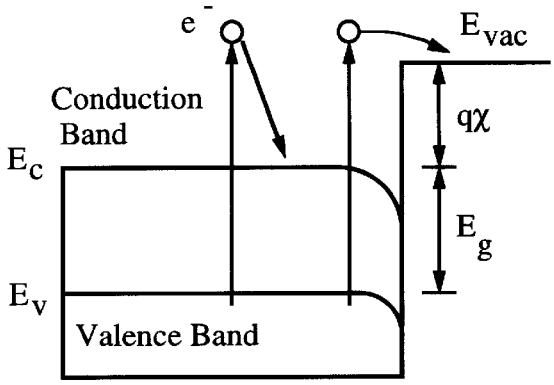
FIG. 8-A
Non-NEA
Semiconductor Cathode
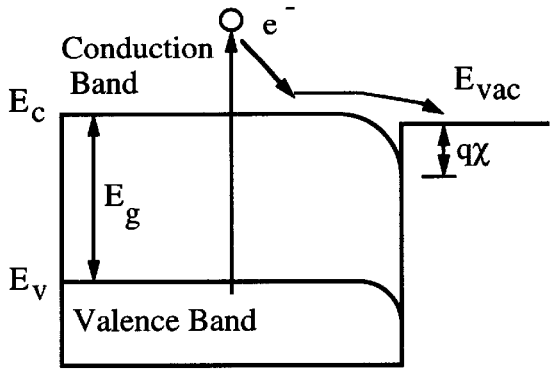
FIG. 8-B
NEA
Semiconductor Cathode
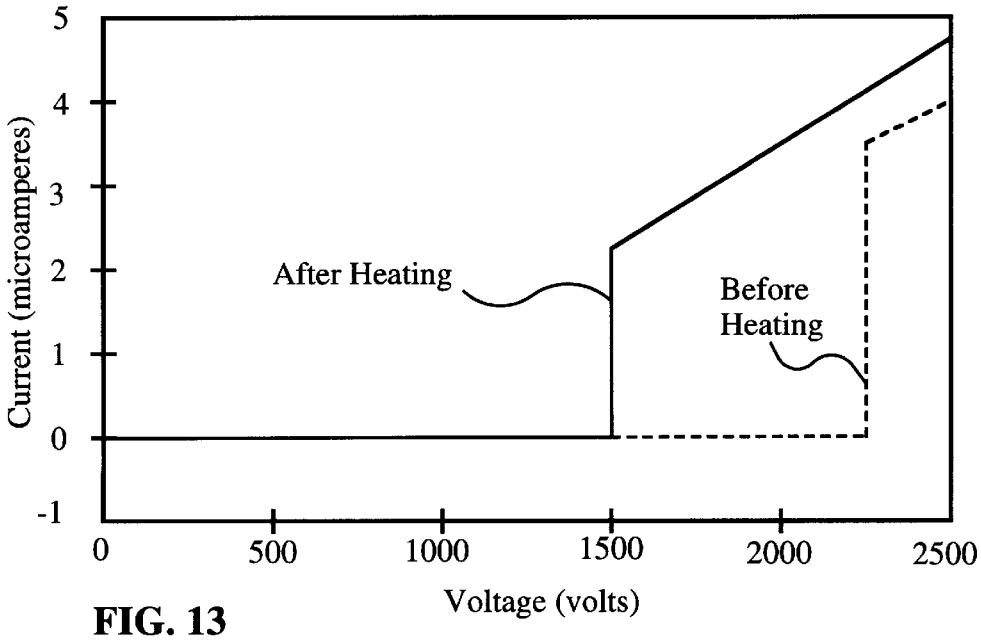
FIG. 13

CARBON-CONTAINING CATHODES FOR ENHANCED ELECTRON EMISSION

This invention was made with government support under Contract Nos. DE-AC03-76SF00515 and DE-AC04-94AL85000, awarded by the Department of Energy. The U.S. government has certain rights in this invention.

RELATED APPLICATION DATA

This application relates to International Patent Application PCT/US94/07395 entitled "Structure and Method for Enhancing Electron Emission from Carbon-Containing Cathodes," which is herein incorporated by reference.

FIELD OF THE INVENTION

The present invention relates to electron-emitting devices, and in particular to a cathode comprising a carbon-containing substrate and electropositive metal atoms chemically bonded to the substrate.

BACKGROUND OF THE INVENTION

An emissive cathode emits electrons during processes such as field emission, thermionic emission, and photoemission. A key parameter governing electron emission from a cathode is the work function of its emitting surface. A low work function is desirable since it generally corresponds to a high emission current. It is also desirable that cathode performance not degrade substantially upon normal operation, or following exposure to air and/or high temperatures.

In one design approach, the emissive cathode consists of a semiconductor substrate coated with an electropositive metallic layer. For a description of cathodes having a GaAs substrate coated with composite Cs—O films, see the article by Rougeot et al. in *Adv. Electronics and Electron Phys.*, 48: 1–36 (1979). For a description of a cathode having a Cs—O-coated Si substrate, see the article by Levine in *Surf. Sci.* 1973, p. 90–107.

Diamond and diamond-like carbon have been proposed as potential substrate materials for semiconductor emissive cathodes. The deposition of a durable layer of electropositive metal on carbon-containing or diamond substrates has proven difficult, however. This difficulty stems from the fragility of the attachment of metal atoms to the substrate. As illustrated by Geis et al. in U.S. Pat. No. 5,463,271, herein incorporated by reference, heating a conventional Cs-coated diamond substrate to a moderate temperature (~200° C.) reverses the cathode performance to that of untreated diamond (see FIG. 5 of Geis et al.).

OBJECTS AND ADVANTAGES OF THE INVENTION

In view of the above, it is a primary object of the present invention to provide a carbon-containing cathode with improved robustness and emission characteristics. It is another object of this invention to provide a cathode comprising a carbon-containing substrate, and an electropositive metallic layer bonded directly to the substrate. It is yet another object of this invention to provide a cathode with a reduced work function. It is still another object of this invention to provide a cathode having a negative electron affinity. It is another object of this invention to provide a cathode capable of resisting exposure to high temperatures. It is yet another object of this invention to provide a cathode allowing restoration of its performance following exposure to air or oxygen. It is a further object of this invention to provide improved light and electron detectors, electron multipliers, and imaging systems. It is another object if this invention to provide improved displays, and in particular flat panel displays.

SUMMARY OF THE INVENTION

An emissive cathode of the present invention comprises a carbon-containing substrate having an electron-emissive surface, and a layer (preferably monolayer) of electropositive metal atoms chemically bonded to the substrate along the emissive surface. The metal atoms facilitate the emission of electrons from the substrate surface. In one embodiment the cathode has a negative electron affinity. The chemical bonds between the metal and the substrate prevent the easy removal of the metallic layer from the substrate.

The atomic fraction of C in the substrate is at least 50% along the surface. In a preferred embodiment, the substrate consists substantially of a synthetic diamond film. In another embodiment, the substrate comprises a diamond like material. A substantial fraction (e.g. >25%) of the carbon atoms of the substrate are tetrahedrally bonded (i.e. hybridized $sp^3$). The electropositive metal atoms are bonded to carbon atoms along the surface. The atomic fraction of the electropositive metal in the metallic layer is at least 50% along the surface. The metal is preferably Cs. Other suitable metals include Ba, K, Na, Sr, Li, Rb, Sc, Y, and La.

A display comprises a plurality of cathodes of the present invention, and a plurality of display elements such as phosphors situated opposite the cathodes, such that electrons emitted from the cathodes are incident on corresponding display elements. In a color display, a cathode corresponds to independently addressable display elements of different colors (red, green and blue). The display may be a flat panel display, or a part of an imaging system having electron multiplication stages.

A detector comprises an end cathode of the present invention, and an anode for detecting electrons emitted by the end cathode. A detection cathode absorbs particles (such as photons or electrons), and emits electrons, thereby inducing an emission of electrons in the end cathode.

An electron multiplier comprises a plurality of multiplier cathodes. First and second multiplier cathodes are situated in an opposite relation, such that electrons emitted by the first multiplier cathode are incident on the second multiplier cathode. The multiplier cathodes are connected to corresponding voltages, where the voltage of the first cathode is less than the voltage of the second cathode.

DESCRIPTION OF THE FIGURES

FIG. 1-A shows schematically a prior art metal-coated cathode comprising electronegative atoms bonded to a carbon-containing substrate.

FIG. 1-B shows schematically a prior art metal-coated hydrogen-terminated carbon-containing cathode.

FIG. 2 shows a cathode of the present invention.

FIG. 3 is a flowchart illustrating possible approaches to making a cathode of the present invention.

FIG. 4-A shows a hydrogen-terminated substrate.

FIG. 4-B shows a bare substrate.

FIG. 4-B' shows a halide-terminated substrate.

FIG. 4-C shows a cathode similar to that shown in FIG. 2, according to the present invention.

FIG. 5-A shows an electron multiplier in a reflection geometry, according to the present invention.

FIG. 5-B shows an electron multiplier in a transmission geometry, according to present invention.

FIG. 6-A shows a part of a monochrome flat panel display of the present invention.

FIG. 6-B shows a part of a color flat panel display of the present invention.

FIG. 7 shows an imaging system of the present invention.

FIG. 8-A is a schematic energy diagram of a positive electron affinity cathode.

FIG. 8-B is a schematic energy diagram of a negative electron affinity cathode of the present invention.

FIG. 13 shows field emission data illustrating the lowering of the field emission threshold voltage by annealing.

DETAILED DESCRIPTION

Figure 9:
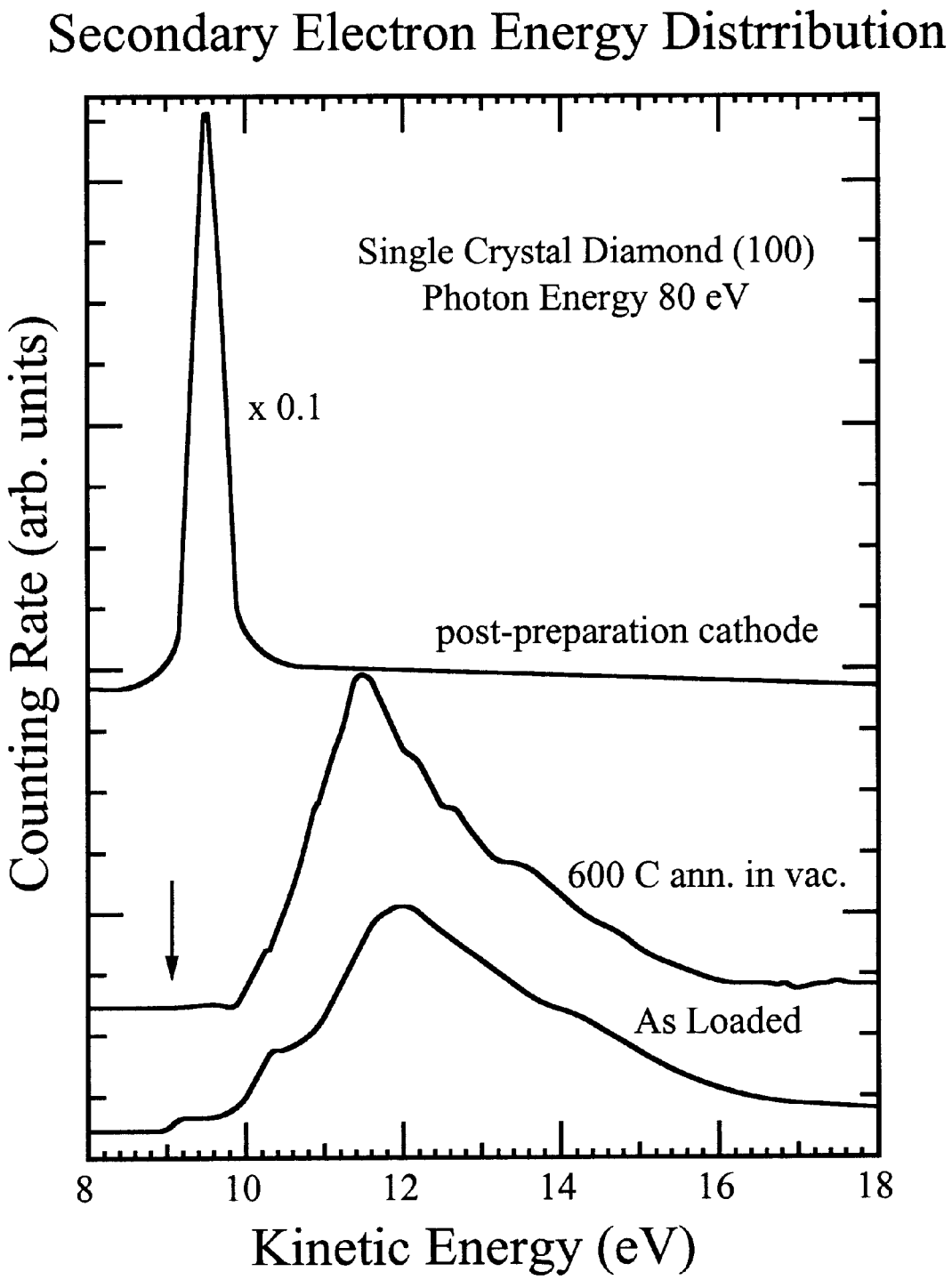
FIG. 9 shows photoemitted electron counts and energy distributions for several cathodes comprising Cs-coated diamond substrates, according to the present invention.

FIG. 1-A shows a prior art cathode described in the above-incorporated U.S. Pat. No. 5,463,271 (Geis et al.). A cathode is mounted on an electrically conductive supporting piece 20. The cathode comprises a carbon-containing substrate 22 having carbon atoms 24 on its emitting surface(s). Electronegative atoms 26 (such as oxygen) are chemically bonded to atoms 24, while electropositive atoms 30 (e.g. Cs) are chemically bonded to atoms 26.

FIG. 1-B shows another prior art cathode having a substrate similar to that in FIG. 1-A. Hydrogen atoms 32 are chemically bonded to carbon atoms 24. Electropositive atoms 34 adhere, but are not chemically bonded, to hydrogen atoms 32. The relative fragility of the attachment of electropositive atoms 34 to substrate 22 results if facile degradation of cathode performance during cathode operation, or upon exposure of the cathode to moderate temperatures (~100° C.) and/or air.

FIG. 2 shows a part of a cathode 40 of the present invention. The electrical contacts to cathode 40 are not shown for simplicity. Cathode 40 is mounted on an electrically conductive support (not shown). A carbon-containing substrate 50 has atoms 52 along an electron-emissive surface 53. At least 50% of atoms 52 are carbon atoms, i.e. an atomic fraction of C in substrate 50 is at least 50% along surface 53. Substrate 50 preferably consists substantially of a synthetic diamond film. Amorphic diamond, silicon-diamond mixtures, diamond-like carbon, and other carbon-containing compounds are also suitable for use in substrate 50.

It is desirable that a substantial fraction (e.g. at least 25%) of the carbon atoms in a substrate of the present invention be tetrahedrally ($sp^3$) bonded, such that the substrate is diamond-like. The properties (bandgap, etc.) of a diamond-like substrate are similar to those of diamond, and dissimilar to those of graphite or metals.

An electropositive metallic layer comprises electropositive metallic atoms 54 chemically bonded to substrate 50 along surface 53. Preferably, the metallic layer is substantially a monolayer, although thicker layers are also suitable in a cathode of the present invention. Atoms 54 are chemically bonded to atoms 52.

The electron affinity (electronegativity) of atoms 54 is preferably less than 0.65. In a preferred embodiment, atoms 54 comprise Cs atoms. In another embodiment, atoms 54 comprise Ba, K or Na atoms. Other electropositive metals such as Li, Rb, Sc, Sr, Y and La can also be used in a cathode of the present invention.

Substrate 50 is electrically conductive, at least along surface 53. Methods for generating electrically conducting diamond, including doping methods, are known in the art. Doping affects the position of the Fermi level in diamond, and thus the type of doping (n or p) is chosen according to the application for which the cathode is used. Nitrogen impurities are typically used to generate n-type diamond, while boron impurities are commonly used for p-type diamond.

FIG. 3 is a flowchart outlining the major steps in making a diamond cathode of the present invention, while FIGS. 4-A through 4-C illustrate the intermediary structures generated during the making of the cathode. A hydrogen plasma treatment is used to clean the surface of the substrate. Hydrogen plasma treatments are well known in the art. For example, a hydrogen plasma treatment is performed for 3 hours at 15 torr and 750 W in a microwave plasma system from Aztecs. The temperature of the substrate stays under ~600° C. during the treatment, as estimated from the absence of glowing in the chamber. A clean hydrogen-terminated surface can also be obtained by oil-polishing the diamond surface. FIG. 4-A shows a hydrogen-terminated substrate 60 having an emissive surface 61. A monolayer of hydrogen atoms 64 is chemically bonded to carbon atoms 62 along surface 61.

It is critical that hydrogen atoms 64 be removed from emissive surface 61 prior to the deposition of an electropositive metallic layer on surface 61. Hydrogen atoms 64 prevent the chemical bonding of electropositive atoms to atoms 62. Depositing an electropositive metal on a hydrogen-terminated surface results in weak adhesion between the metal and the carbon atoms within the substrate. Consequently, a typical cathode having an electropositive metal deposited on a hydrogen-terminated substrate surface is susceptible to exposure to air and/or high temperatures. Several methods are available for the removal of hydrogen atoms 64.

In one approach, hydrogen atoms 64 are removed by annealing substrate 60 to >800° C. Substrate 60 is heated to 950° C. (in general 800–1200° C.) for about 10 minutes (in general from a few minutes to hours) under vacuum ($10^{-7}$ torr or lower). Overheating may lead to transformation of diamond into graphite at surface 61. The heating desorbs any adsorbates on surface 61, and removes hydrogen atoms 64. The article by Pate "The Diamond Surface: Atomic and Electronic Structure" in *Surf. Sci.* 162: 83 (1986), herein incorporated by reference, contains a description of an annealing method for removing the hydrogen monolayer from an as-polished diamond surface. The Pate article also contains a discussion of the consequences of annealing, including surface structural changes. The resulting substrate is shown schematically in FIG. 4-B.

In another approach to removing hydrogen atoms 64, surface 61 is bombarded by energetic particles such as electrons, ions, or molecules. A majority (ideally, substantially all) of hydrogen atoms 64 are removed from surface 61. Bombardment methods suitable for removing hydrogen atoms 64 are known in the art. Care should be taken so that the bombardment does not physically damage substrate 60.

Once hydrogen atoms 64 are removed, electropositive metal atoms 80 are deposited on surface 61, yielding the cathode of FIG. 4-C. Techniques, such as vapor deposition, for depositing electropositive metals on diamond are well known in the art. The deposition is preferably done under good vacuum (pressures of $10^{-9}$ torr or lower), using either a pure metal source or a metal compound source. Suitable metal sources are available commercially. Suitable deposition temperatures, evaporation rates and treatment durations can be readily determined by the skilled artisan, depending on the source used and the geometry of the deposition chamber.

Atoms 80 form chemical bonds with atoms 62. The dipole moments of the metal-carbon bonds act to reduce the work function of the cathode. Preferably, atoms 80 form a monolayer. If a thicker layer of atoms 80 is originally deposited on surface 61, substrate 60 is heated to a moderate temperature for a period of time sufficient to allow the evaporation of the metal atoms not chemically bonded to surface 61.

FIG. 4-B' illustrates a preferred approach for removing hydrogen atoms 64. Atoms 64 are replaced by electronegative atoms 66 by exposing substrate 60 to a plasma of electronegative atoms 66. Atoms 66 are halogen atoms (F, Cl, Br or I). Halogen plasma treatment methods are known in the art. For example, a $SF_6$ plasma is used in a RF plasma system (reactive ion etcher) from Ion and Plasma Equipment, Inc., for 5 minutes at 50 W and under 20 mtorr pressure. The temperature of substrate 60 during the halogen plasma treatment is less than 200° C. For a description of another method of fluorinating diamond, see for example the article by Ando et al. "Diffuse Reflectance Fourier Transform Infrared Study of the Plasma Fluorination of Diamond Surface Using a Microwave Discharge in $CF_4$," *J. Chem. Soc. Faraday Trans* 89 (1993), which is herein incorporated by reference.

The halogen-coated substrate is exposed to an excess of electropositive metal, and moderately heated to a temperature (as low as 150° C.) sufficient to remove the resulting metal halide molecules from surface 66. Suitable heating temperatures and heating durations can readily be determined by the skilled artisan. The excess electropositive metal bonds chemically to atoms 62, yielding the cathode of FIG. 4-C.

Once manufactured, a cathode of the present invention is preferably protected from exposure to air or oxygen, and is electrically connected to a power supply (not shown). Electron emission from the cathode is induced thermally (thermionic emission), optically (photoemission), or electrically (field emission). The type of electron emission chosen depends on the application of the cathode.

Particularly useful applications of a cathode of the present invention include detectors, electron multipliers, and displays. In a display, a cathode of the present invention generates electrons which are absorbed by display element (s), which in turn emit photons. In a detector, the cathode absorbs photons, electrons, or other energetic particles (e.g. $\gamma$- or $\alpha$-rays), and in turn emits electrons. In an electron multiplier, the cathode absorbs a number electrons and, in turn, emits a larger number of electrons.

A cathode of the present invention is suitable for use as a photocathode. Photons incident on the cathode induce the emission of electrons from the cathode. The electrons are detected at an anode. For general information on semiconductor negative-electron-affinity (NEA) photocathodes, see for example Chapter 57 of *Complete Guide to Semiconductor Devices* by Ng, McGraw-Hill, 1995.

A cathode of the present invention is also suitable for use in an electron multiplier. Electron multipliers are known in the art, and will be described here only briefly. FIG. 5-A illustrates schematically an electron multiplier 120 comprising a plurality of cathodes (or dynodes) arranged in a reflection geometry. Adjacent cathodes 122, 124, and 126 are held at corresponding voltages $V[n-1]<V[n]<V[n+1]$, and are situated in an opposite relation such that electrons emitted by cathode 122 are incident on cathode 124, and electrons emitted by cathode 124 are incident on cathode 126. Cathode 124 absorbs and emits electrons from the same surface 128. An anode 130 at a voltage V' collects electrons emitted by a last cathode 132. Other cathode arrangements for reflection-mode electron multipliers are known in the art.

FIG. 5-B illustrates an electron multiplier 150 comprising a plurality of cathodes (or dynodes) arranged in a transmission geometry. Adjacent cathodes 152, 154, and 156 are held at corresponding voltages $V[n-1]<V[n]<V[n+1]$, and are separated by electrically insulating spacers 158. Electrons emitted by cathode 152 are incident on an absorption surface 160 of cathode 154, and generate an emission of electrons from the substrate of cathode 154, through an emissive surface 162 of cathode 154. Emissive surface 162 is opposite absorption surface 160. Electropositive metal atoms are chemically bonded to the substrate of cathode 154 along emissive surface 162. An anode 164 at a voltage V' collects electrons emitted by a last cathode 166.

FIG. 6-A shows schematically a pixel of a black-and-white flat panel display. A cathode 180 is mounted on an electrically conductive substrate 182. A display element 184 is mounted on a transparent glass faceplate 186 opposite cathode 180, such that electrons generated by cathode 180 are absorbed by display element 184. Field emission is used to extract electrons from cathode 180. Display element 184 comprises a phosphor capable of emitting photons through faceplate 186 upon absorption of electrons from cathode 180.

FIG. 6-B shows schematically a part of a color flat panel display. First, second, and third display elements 188, 190, and 192 comprise red, green and blue phosphors, respectively, and can be accessed selectively by electrons emitted from cathode 180. A flat panel display using cathodes of the present invention can approach the performance of a cathode ray tube display, while being more compact and consuming less power. At the same time, a flat panel display using cathodes of the present invention is not subject to some of the disadvantages of other display technologies such as liquid crystal displays (limited size and viewing angles), electroluminescence (inferior addressability), or LED (complexity of design).

FIG. 7 shows an imaging system 200 comprising a plurality of cathodes arranged in a transmission geometry. The cathode arrangement is similar to that shown in FIG. 5-B. Barriers 202 focus the emission of electrons through apertures 204. A phosphor layer 206 attached to a glass plate 208 emits photons upon absorption of electrons. A system such as system 200 is suitable for medical imaging applications. An imaging system using a cathode of the present invention allows a wider dynamic range, higher operation speeds, a larger display area, lower operating temperatures, a simpler design, and higher resolutions than currently available imaging systems.

The following discussion and examples are intended to illustrate the invention, and should not be construed to limit the invention.

DISCUSSION AND EXAMPLES

FIGS. 8-A and 8-B show energy diagrams for simple (uncoated) semiconductor cathodes having positive and negative electron affinities, respectively. The horizontal axis denotes position, while the vertical axis denotes energy. The figures also illustrate photoemission from the two cathodes. In photoemission, electrons are excited inside the cathode by incident light, migrate to an emissive surface of the cathode, and exit the cathode through the emissive surface.

The energy $E_g$ is the difference between the valence and conduction band energies, while $\chi$ (the electron affinity) is the potential difference between the vacuum level and the bottom of the conduction band. To exit the cathode, an electron in the valence band needs to gain at least $$h\nu = E_g + q\chi \quad [1a]$$

for the cathode of FIG. 8-A, or $$h\nu = E_g \quad [1b]$$

for the cathode of FIG. 8-B, where q is the electron charge. In the cathode in FIG. 8-B, the difference between the vacuum level and the bulk value of $E_C$ is negative; such a cathode is commonly referred to as a negative electron affinity (NEA) cathode.

In a positive-electron-affinity photocathode, photoexcited electrons that are not close (relative to the mean free path) to the emissive surface scatter down to the bottom of the conduction band ($E_C$), and thus become less energetic than the vacuum level before reaching the surface, as illustrated in FIG. 8-A. The electrons eventually emitted by a positive-electron-affinity photocathode are originally excited relatively close to the surface, and are above the vacuum level upon migration to the cathode surface. The energy distribution of electrons generated by such a cathode is in general relatively wide. In a negative-electron-affinity (NEA) photocathode, electrons resting at $E_C$ migrate to the cathode surface upon the application of a suitable electric field. The energy distribution of the electrons generated by a NEA photocathode is relatively narrow.

A key parameter controlling electron emission (thermionic emission, photoemission, or field emission) is the energy difference $\phi_B$ between the vacuum level and the highest occupied electron states. For an undoped semiconductor, $\phi_B$ is the energy difference between the vacuum level and the top of the valence band, while for a doped semiconductor $\phi_B$ is the difference between the vacuum level and the dopant level. For a n-type material the dopant level is close to the conduction band, while for a p-type material the dopant level is close to the valence band. For thermionic emission, the emission current is given by $$I = AT^2 e^{-\phi_B/kT}, \quad [2]$$

while for field emission the emission current is given by $$I = \frac{A'V^2}{\phi_B} e^{-C\phi_B^{3/2}/V} e^{D/\sqrt{\phi_B}}, \quad [3]$$

where V is the applied voltage, T is the cathode temperature, k is the Boltzmann constant, and A, A', C and D are structural constants of the cathode. As can be seen from Eqs. [2] and [3], the emission current I is extremely sensitive to $\phi_B$.

The vacuum level, and consequently the value of $\phi_B$, of a cathode can be reduced by generating strong dipoles pointing toward the cathode substrate. Such dipoles are generated in the present invention by treating the cathode substrate with an electropositive metal. The difference in energies $\phi_B$ of untreated and metal-treated cathodes is given by $$\Delta\phi = 2\pi N P_i, \quad [4]$$

where N is the dipole density and $P_i$ is the dipole moment of the substrate-metal bond. For a Cs-coated diamond substrate, the large dipole moment of the Cs—C chemical bonds leads to a significant reduction in $\phi_B$, as compared to a hydrogen-terminated diamond substrate.

Some hydrogen-terminated uncoated diamond cathodes have been shown to have low barriers $\phi_B$. The maximum currents generated by such cathodes have been generally very low, however. Cs-coated hydrogen-terminated diamond cathodes have lower barriers $\phi_B$ than uncoated cathodes, but are sensitive to high temperatures and/or exposure to air. A cathode of the present invention, comprising electropositive metal atoms chemically bonded to a carbon-containing substrate, is relatively robust. In one embodiment, the cathode also displays a negative electron affinity.

Although the NEA condition is desirable in a cathode of the present invention, the NEA condition is not absolutely required. For example, it may be very difficult to achieve the NEA condition for a n-type substrate, since in practice the vacuum level cannot be brought too close to the Fermi level. A n-type substrate may be desirable for some applications, however, even though such a substrate may not allow NEA.

As is apparent to the skilled artisan, field emission from a cathode can be enhanced geometrically, i.e. by defining sharp features on the cathode surface. Such sharp features enhance locally the electric field at the cathode surface, for a given potential applied to the cathode. Ways of defining sharp geometric features on surfaces of various materials are known in the art.

FIG. 9 shows the energy distributions of photoexcited electrons emitted by three (100) type II-B diamond cathodes: a hydrogen-terminated as-installed cathode, a hydrogen-terminated cathode following annealing to 600° C., and a cathode of the present invention having Cs atoms directly bonded to C atoms of the substrate. The large energy absolute values are due to the acceleration of the electrons through a potential following emission. The hydrogen-terminated as-installed diamond displays low emission current and a broad peak. By contrast, the Cs-treated cathode shows a high emission current and a very narrow peak corresponding to electrons emitted from the conduction band minimum $E_C$ (see FIG. 8-B). The narrow peak is indicative of negative electron affinity. The narrow energy distribution allows easy focusing of the electrons, which is critical in some applications.

Figure 10:
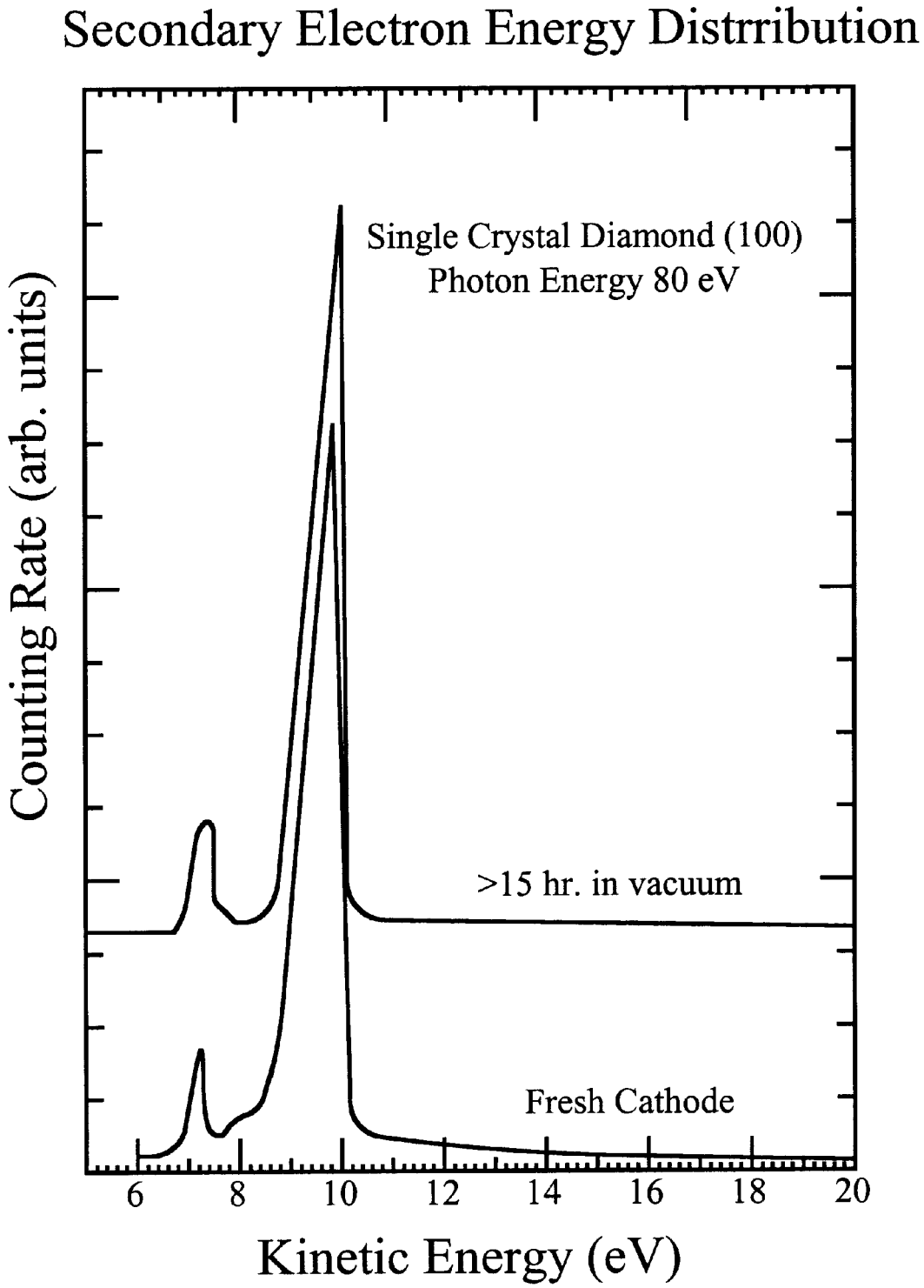
FIG. 10 illustrates the durability of a cathode of the present invention.

FIG. 10 shows electron energy distributions for a fresh cathode and a cathode after >15 hours of operation in vacuum. The two curves are vertically displaced for clarity of presentation. FIG. 10 illustrates the excellent durability of a cathode of the present invention. The performance of the cathode does not degrade substantially following 15 hours of operation in vacuum.

Figure 11:
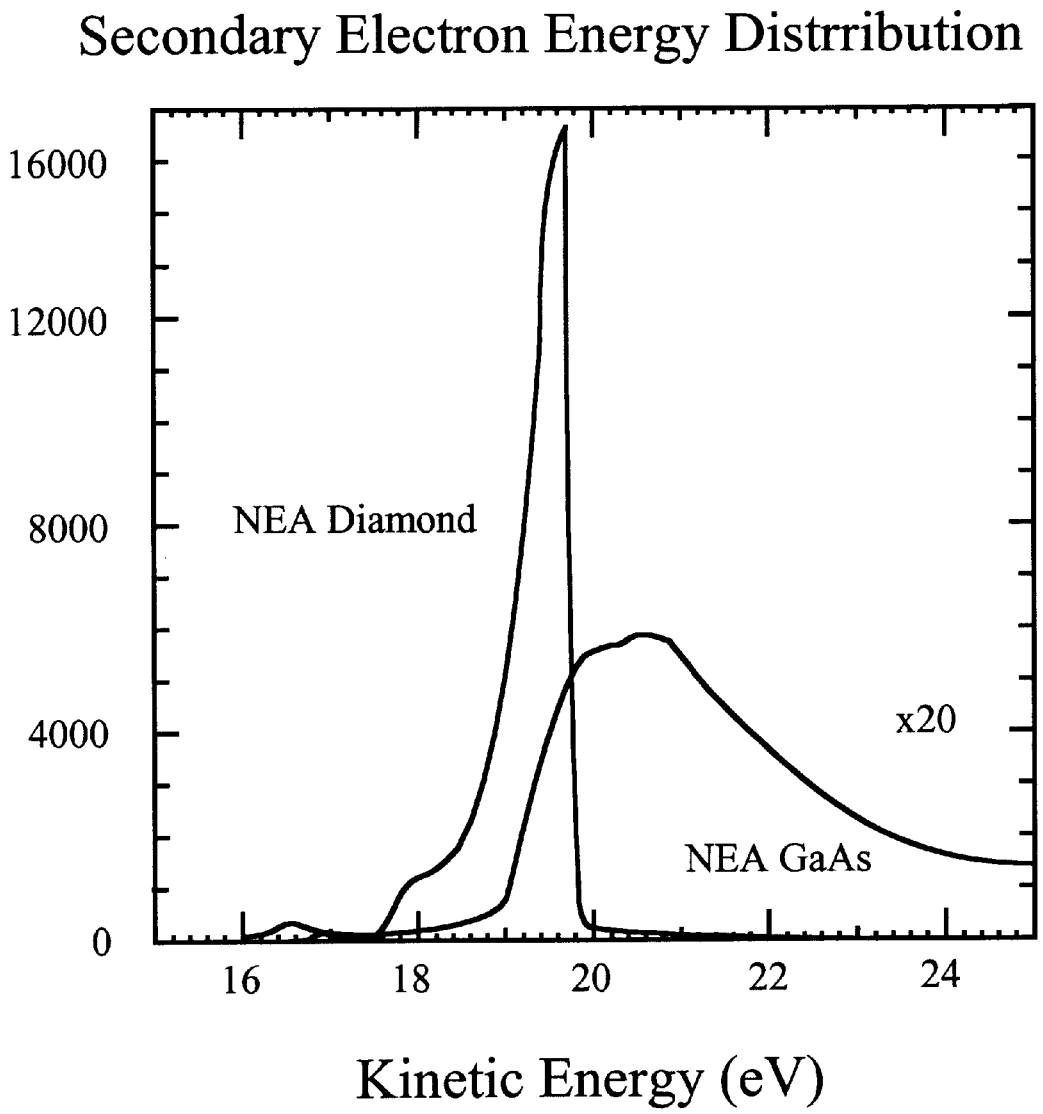
FIG. 11 shows a comparison of a cathode of the present invention with a cathode having a GaAs substrate.

FIG. 11 shows electron energy distributions for a diamond cathode of the present invention and a Cs-coated GaAs cathode. The actual counts for the GaAs cathode are 20 times lower than those displayed. The counts and energy distribution of electrons emitted by the diamond cathode are superior to those of electrons emitted by the GaAs cathode.

The lifetime of a cathode depends strongly on its operating environment. Electronegative contaminants from its environment adsorb onto the cathode surface, and weaken the surface dipole strength (see Eq. [4]). The contaminants can be removed without causing damage to the cathode.

Figure 12:
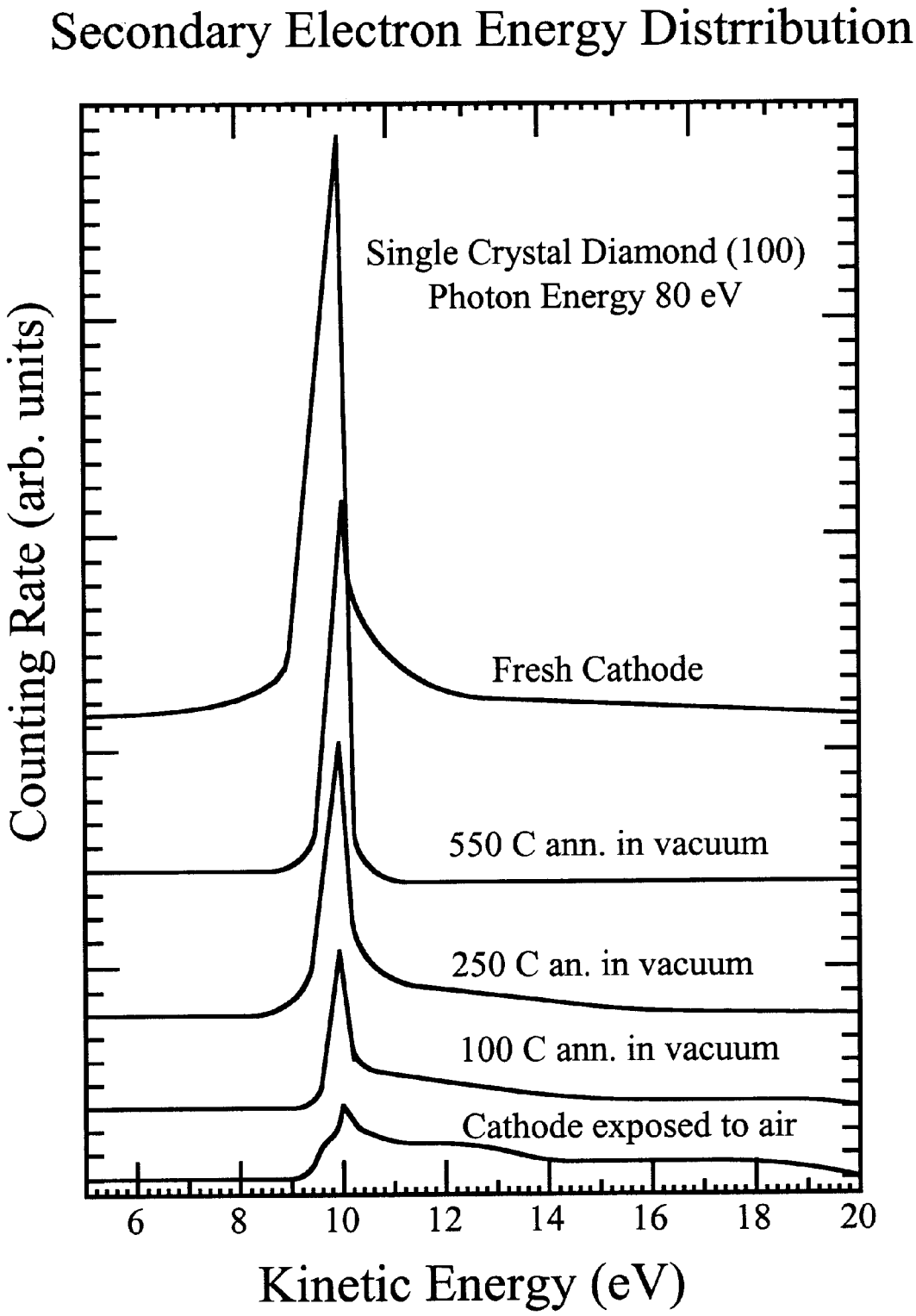
FIG. 12 shows photoemission data illustrating the restoration of the performance of a cathode of the present invention by annealing, following exposure to air.

FIG. 12 shows the number of electrons emitted by a diamond cathode of the present invention under several conditions: fresh, after exposure to air, and following subsequent annealing for restoring the damage caused by the exposure to air. As illustrated, annealing to 550° C. causes a partial restoration of the cathode performance. The performance of a cathode of the present invention can also be restored, following exposure to oxygen, by an appropriate electron beam treatment, or by the deposition of additional Cs on the cathode (data not shown). FIG. 13 shows schematically the results of field emission measurements performed on a diamond cathode of the present invention, following exposure to oxygen and subsequent annealing for restoring the cathode performance. The threshold voltage for emission is significantly lowered following annealing.

It will be clear to one skilled in the art that the above embodiments may be altered in many ways without departing from the scope of the invention. Various cathode geometries, and arrangements of cathodes are known in the art. Many carbon-containing materials, including diamond-like carbon, are suitable for a substrate of the present invention. It may be desirable to coat only part of the substrate surface with metal. The substrate may comprise a thin diamond film deposited on a thicker layer. In addition, there are many potential ways of making a cathode of the present invention. Accordingly, the scope of the invention should be determined by the following claims and their legal equivalents.

What is claimed is:

1. An emissive cathode comprising:

a) a substrate comprising a carbon-containing electron-emissive surface; and b) electropositive metal atoms chemically bonded to carbon atoms of said electron-emissive surface;

whereby said metal atoms serve to facilitate an emission of electrons from said electron-emissive surface.

2. The cathode of claim 1 wherein an atomic fraction of carbon on said electron-emissive surface is at least 50%.

3. The cathode of claim 1 wherein said substrate comprises diamond.

4. The cathode of claim 1 wherein a substantial fraction of carbon atoms in said substrate are tetrahedrally bonded, whereby said substrate is diamond-like.

5. The cathode of claim 1 wherein an electron affinity of said metal atoms is less than 0.65.

6. The cathode of claim 1 wherein said metal atoms form an electropositive metallic layer chemically bonded to said electron-emissive surface.

7. The cathode of claim 6 wherein said metallic layer consists substantially of a monolayer.

8. The cathode of claim 1 wherein said metal atoms comprise Cs atoms.

9. The cathode of claim 1 wherein said metal atoms comprise atoms of a metal selected from the group consisting of Ba, K, and Na.

10. The cathode of claim 1 wherein said metal atoms comprise atoms of a metal selected from the group consisting of Sr, Li, Rb, Sc, Y, and La.

11. The cathode of claim 1 wherein said cathode has a negative electron affinity.

12. A display comprising:

a) an emissive cathode comprising;

a substrate comprising a carbon-containing electron-emissive surface, and electropositive metal atoms chemically bonded to carbon atoms of said electron-emissive surface, whereby said metal atoms serve to facilitate an emission of electrons from said substrate; and b) a display element situated opposite said surface, such that electrons emitted from said electron emissive surface are incident on said display element.

13. The display of claim 12 comprising a first display element adapted to emit photons of a first color, and a second display element adapted to emit photons of a second color distinct from said first color.

14. The display of claim 13 wherein said first display element and said second display element are independently addressable by said cathode.

15. A detector comprising:

a) an end cathode comprising a substrate comprising a carbon-containing electron-emissive surface, and electropositive metal atoms chemically bonded to carbon atoms of said electron-emissive surface, whereby said metal atoms serve to facilitate an emission of electrons from said substrate; and b) an anode for detecting electrons emitted by said end cathode.

16. The detector of claim 15 further comprising a detection cathode adapted to absorb a particle selected from the group consisting of photons and electrons, wherein said detection cathode is adapted to induce an emission of electrons from said end cathode upon an absorption of said particle into said detection cathode.

17. An electron multiplier comprising a first multiplier cathode and a second multiplier cathode, wherein:

a) said first multiplier cathode is situated opposite said second multiplier cathode, such that electrons emitted by said first multiplier cathode are incident on said second multiplier cathode; and b) said first multiplier cathode comprises a substrate comprising a carbon-containing electron-emissive surface, and electropositive metal atoms chemically bonded to carbon atoms of said electron-emissive surface, whereby said metal atoms serve to facilitate an emission of electrons from said substrate.

18. The multiplier of claim 17 wherein an absorption surface of said first cathode is opposite said emissive surface of said first cathode.

19. An emissive cathode structure comprising:

a substrate with a carbon-containing surface and an electropositive metal layer is in contact with said surface and wherein said metal layer serves to facilitate an emission of electrons from said substrate.

20. The cathode structure of claim 19 wherein said electropositive metal layer is in contact with said carbon-containing surface through carbon-metal bonds.

21. The cathode structure of claim 20 wherein said metal layer is essentially a monolayer.

22. A method of making an emissive cathode structure comprising the steps of providing a substrate with a carbon-containing electron-emissive surface wherein said surface is substantially free of hydrogen, oxygen and fluoride and depositing an electropositive metal layer directly on said surface such that a carbon-metal bonds are formed.

23. A method of claim 22 wherein said electropositive metal is selected form the group consisting of Cs, Ba, K, Ma, Sr, Li, Rb, Sc, Y and La.

* * * * *